US005408851A

United States Patent [19]

Tsuchiya

[11] Patent Number: 5,408,851

[45] Date of Patent: Apr. 25, 1995

[54] APPARATUS FOR REMOVING FIBER WASTE FROM THE KNITTING UNIT OF A CIRCULAR KNITTING MACHINE

[75] Inventor: Koji Tsuchiya, Hyogo, Japan

[73] Assignee: Precision Fukuhara Works, Ltd., Japan

[21] Appl. No.: 217,419

[22] Filed: Mar. 24, 1994

[30] Foreign Application Priority Data

Apr. 9, 1993 [JP] Japan ..... 5-107430

[51] Int. Cl.[6] ..... D04B 35/32

[52] U.S. Cl. ..... 66/168

[58] Field of Search ..... 66/168, 8; 15/405; 57/303, 304

[56] References Cited

U.S. PATENT DOCUMENTS 5,201,793 4/1993 Izumi et al. ..... 66/168

*Primary Examiner*—John J. Calvert

*Attorney, Agent, or Firm*—Bell, Seltzer, Park & Gibson

[57] ABSTRACT

Apparatus for removing fiber waste from the knitting instrumentalities of a circular knitting machine including an air jet for blowing a high velocity stream of air thereonto, the air jet is mounted for rotation coaxially with the rotary cylinder of the circular knitting machine, a drive independent of the drive of the circular knitting machine for rotating the air jet in one direction for a predetermined distance or time interval and for then reversing the direction of rotation for a predetermined distance or time interval, and an air supply which supplies compressed air to the air jet while accommodating the different directions of rotation thereof.

8 Claims, 3 Drawing Sheets

APPARATUS FOR REMOVING FIBER WASTE FROM THE KNITTING UNIT OF A CIRCULAR KNITTING MACHINE

FIELD OF THE INVENTION

This invention relates generally to circular knitting machines and more particularly to apparatus for removing fiber waste, such as dust, lint and the like, from the knitting instrumentalities of a circular knitting machine.

BACKGROUND OF THE INVENTION

The high speed operation of circular knitting machines can generate considerable fiber waste, such as dust, lint and/or flock, from the yarns being knitted to form the fabric. Such fiber waste tends to accumulate on the knitting machine parts, particularly on the knitting section thereof, e.g. yarn carriers, cylinder, dial or sinker cap and the needles and/or sinkers. Unless quickly removed, such fiber waste can be knit into the fabric which will substantially reduce the quality thereof and can cause damage to the knitting instrumentalities, e.g. needle breakage.

Various types of cleaning devices for such circular knitting machines have been proposed. The most common of these devices include air blowing nozzles for directing high velocity streams of air against the knitting instrumentalities. Examples of such cleaning devices are disclosed in U.S. Pat. Nos. 4,691,536 and 5,201,793 owned by the assignee of this application.

These known devices usually provide for rotation of the air nozzles or air jets in the same or opposite direction to the direction of rotation of the needle cylinder of the circular knitting machine. While generally effective for removing fiber waste from the knitting instrumentalities, such cleaning devices provide for rotation of the air nozzles or air jets by incorporating the driving means therefor into the driving mechanism of the circular knitting machine at the time of manufacture of the knitting machine or by a major modification of the circular knitting machine. Once installed, such cleaning devices are very difficult to service and/or repair where such service or repair requires demounting and remounting the same. Also, the inclusion of such prior cleaning devices is very difficult, time consuming and expensive.

SUMMARY OF THE INVENTION

With the foregoing in mind, it is an object of this invention to provide apparatus for removing fiber waste which may be easily installed on either new or existing machines and which obviates the disadvantages and deficiencies of prior cleaning devices.

This object is achieved by providing at least one air nozzle or air jet directed downwardly toward the knitting section of the circular knitting machine, rotary support means mounting the air jet for rotation relative to the knitting section of the circular knitting machine, drive means for driving the rotary support means alternately in the same direction as the needle cylinder of the circular knitting machine and in the opposite direction thereto, and means for supplying air to the air jet. The air supplying means includes a movable pipe connected at one end to the air jet for movement therewith while the other end thereof is anchored and connected to a source of compressed air. The air supply pipe is constructed and arranged such that as the air jet rotates the movable end of the pipe will travel therewith while the other end remains stationary.

BRIEF DESCRIPTION OF THE DRAWINGS

Some of the objects and advantages of the present invention having been stated, others will appear as the description proceeds when considered in conjunction with the accompanying schematic drawings, in which.

DETAILED DESCRIPTION OF THE PREFERRED EMBODIMENTS

Figure 1:
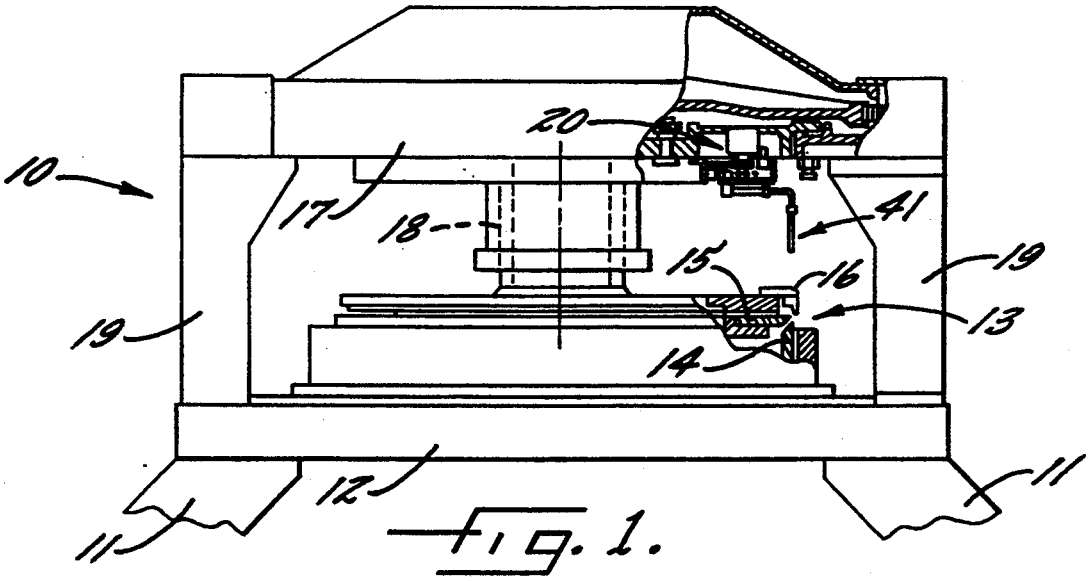
FIG. 1 is a fragmentary elevational view, partially in section, of a circular knitting machine incorporating the fiber waste cleaning apparatus of the present invention.

Referring now more particularly to the drawings, there is illustrated in FIG. 1 a circular knitting machine generally indicated at 10. Circular knitting machine 10 includes a plurality of legs 11 supporting a bed 12 which in turn supports a knitting section 13. Knitting section 13 includes a rotary cylinder 14 which carries cylinder needles (not shown), a rotary dial 15 which carries dial needles (not shown) and yarn carriers 16 (only one of which is shown).

In some circular knitting machines, the rotary dial 15 is not included, but a sinker cap (not shown) and sinkers carried thereby (also not shown) cooperate with the cylinder 14 and cylinder needles to form the knit fabric. All of the foregoing is conventional circular knitting machine structure well known to those skilled in the knitting art.

The rotary cylinder 14 and rotary dial 15 are supported from a top bed 17 by a drive shaft assembly 18. Top bed 17 is supported on lower bed 12 by spaced standards 19.

Figure 2:
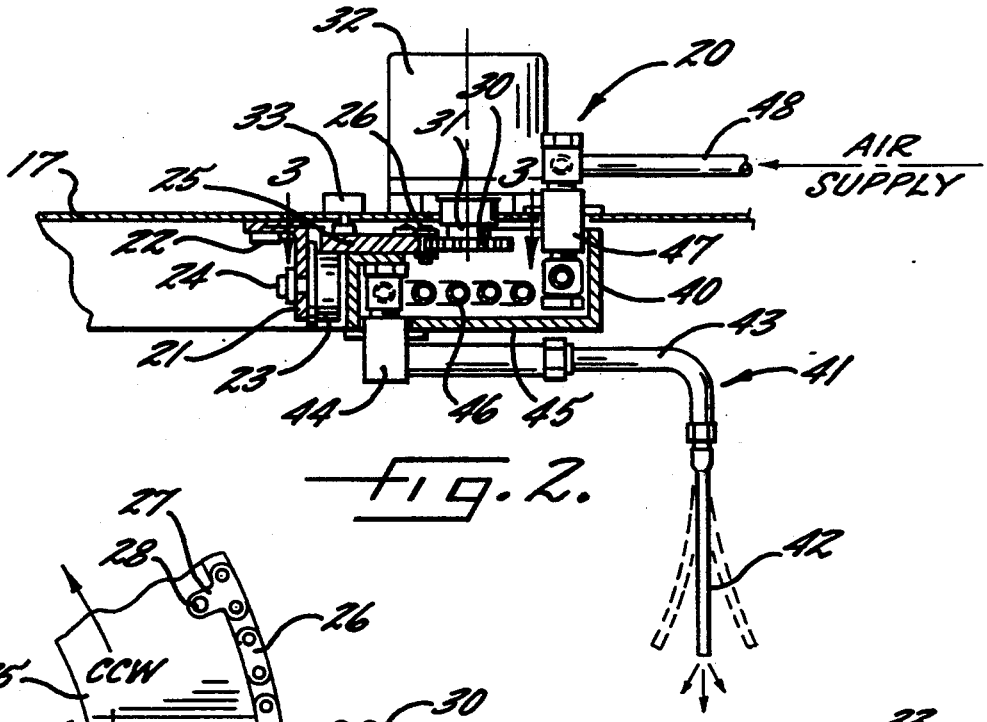
FIG. 2 is an enlarged fragmentary sectional view of one embodiment of the fiber waste cleaning apparatus shown in FIG. 1.

A fiber waste removing apparatus 20 is carried by top bed 17 of knitting machine 10 above knitting section 13. Fiber waste removing apparatus 20 includes a support ring 21 that is mounted on the bottom of top bed 17 by suitable bolts 22 (FIGS. 1 and 2). Support ring 21 has a diameter less than the diameter of dial 15. A plurality of spaced apart rollers 23 are mounted on support ring 21 by stub shafts 24.

Figure 3:
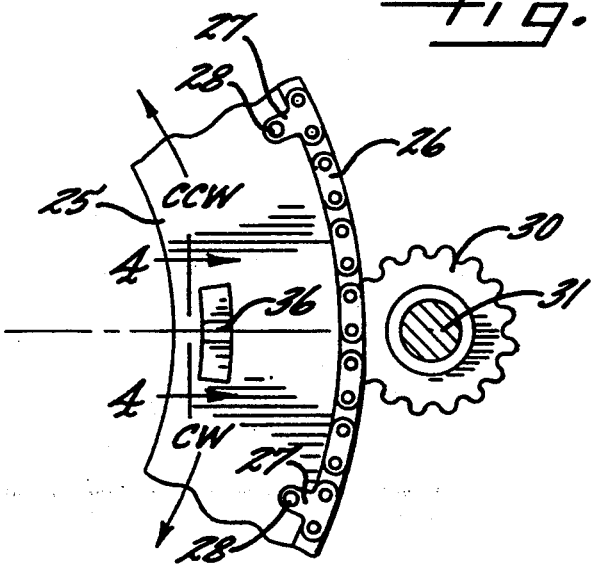
FIG. 3 is an enlarged fragmentary sectional view taken substantially along line 3—3 in FIG. 2.

A carrier ring member 25 is supported by rollers 23 for rotation relative to the support ring 21 and rollers 23. Carrier ring member 25 may have gear teeth formed in the outer periphery thereof, but preferably a roller chain 26 is mounted on the outer periphery of carrier ring member 25 by brackets 27 and pins 28 (FIG. 3). The rollers of roller chain 26 are spaced apart in such a manner as to mesh with the teeth of a drive gear or sprocket 30 mounted on the output shaft 31 of a reversible drive motor 32.

Drive motor 32 is mounted on top bed 17 by suitable motor mounts (not shown). Further, drive motor 32 is connected to a suitable source of electrical power (not shown). Accordingly, when activated, drive motor 32 rotates drive gear 30 which drives carrier ring member 25 in rotation through roller chain 26.

Figure 4:
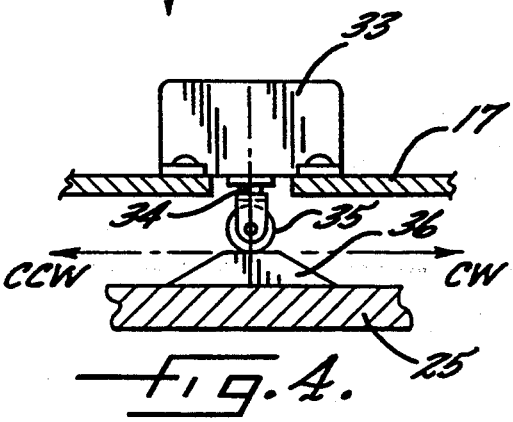
FIG. 4 is an enlarged fragmentary sectional view taken substantially along line 4—4 in FIG. 3.

A reversing switch 33 is mounted on top bed 17 and includes an actuator 34 which extends downwardly to a point overlying carrier ring member 25. Actuator 34 has a cam follower roller 35 mounted on the lower end thereof which is adapted to be engaged by a cam 36 mounted on the upper surface of carrier ring member 25 (FIG. 4). Switch 33 is electrically connected to reversible drive motor 32 so that each time switch 33 is actuated by cam 36 engaging roller 35 and raising actuator 34, the drive motor 32 reverses the direction in which it rotates drive gear 30.

If less than a 360° rotation of carrier ring member 25 is desired, then more than one cam 36 can be provided on carrier ring member 25. Similarly, a timing switch may be used instead of switch 33 to reverse the drive motor 32 after a predetermined time interval correlated to the distance the carrier ring member 25 would travel in that time interval.

Carrier ring member 25 carries a housing 40 mounted on the bottom surface thereof. An air jet or nozzle assembly 41 is mounted on housing 40 and extends downwardly and outwardly therefrom. Air jet assembly 41 includes an air jet or nozzle 42 which preferably is of a type that flutters or flexes as it directs a high velocity stream of air therethrough. Such an air jet or nozzle is disclosed in U.S. Pat. No. 4,691,536 owned by the assignee of this application.

Air jet 42 is carried by one end of an air feed pipe 43 which is connected at its other end to a first air joint 44. First air joint 44 is carried by the bottom wall 45 of housing 40 and penetrates therethrough. An air supply tube or pipe 46 is contained in housing 40 and is connected at one end thereof to first air joint 44 and at its other end to a second air joint 47. Second air joint 47 is stationary and is mounted on top bed 17. Second air joint 47 is connected to an air feed tube or pipe 48 which in turn is connected to a source of compressed air (not shown).

Air supply pipe 46 is preferably arranged in a spiral coil (FIG. 5) and may be formed of any suitable material that will permit the pipe 46 to be wound into a spiral and to unwind and rewind as the air jet assembly 41 moves around with carrier ring member 25.

Figure 5:
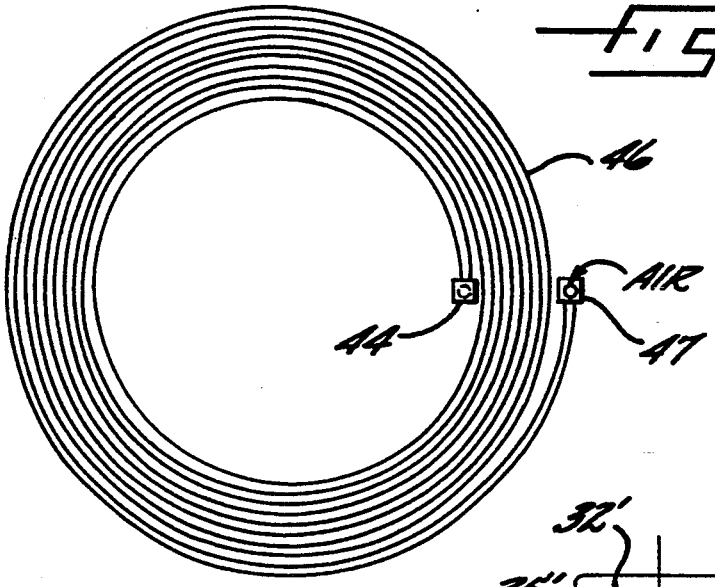
FIG. 5 is an enlarged fragmentary plan view of the spiral air supply pipe shown in FIG. 2.

In this regard, as carrier ring member 25 is driven in rotation by motor 32 in a counterclockwise direction, the housing 40 moves therewith in the same direction as does the air jet assembly 41, first air joint 44 and the end of air supply pipe 46 connected to air joint 44. As seen in FIG. 5, the spiral wound air supply pipe 46 will unwind until cam 36 actuates reversing switch 33, usually one 360° revolution. Upon rotation in the opposite, clockwise direction, the spiral wound air supply pipe 46 rewinds to its original wound condition.

Further, while only one air jet assembly 41 is illustrated, it should be understood that a plurality of such air jet assemblies may be provided around the bottom wall 45 of housing 40. In such an event, a corresponding number of first air joints 44 would be provided and each would be connected to the inside convolution of the spiral wound air supply pipe 46 at suitable, spaced-apart locations.

Figure 6:
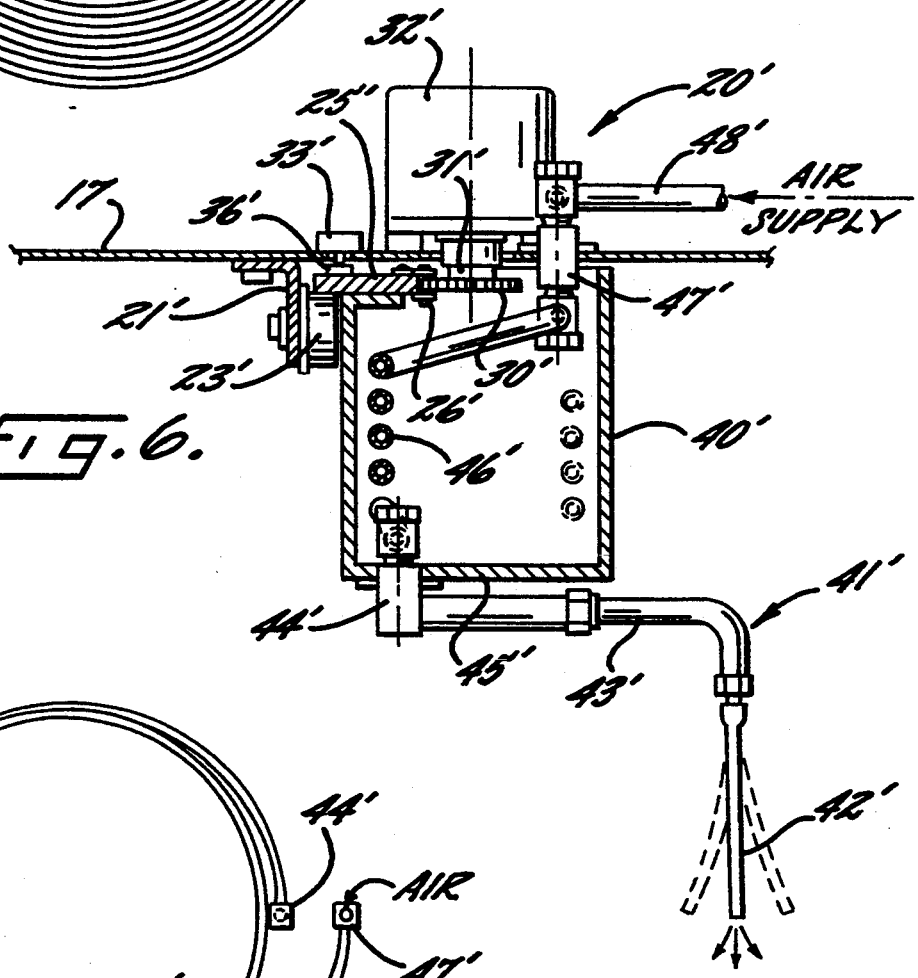
FIG. 6 is a view similar to FIG. 2 of another embodiment of the apparatus of the present invention.
Figure 7:
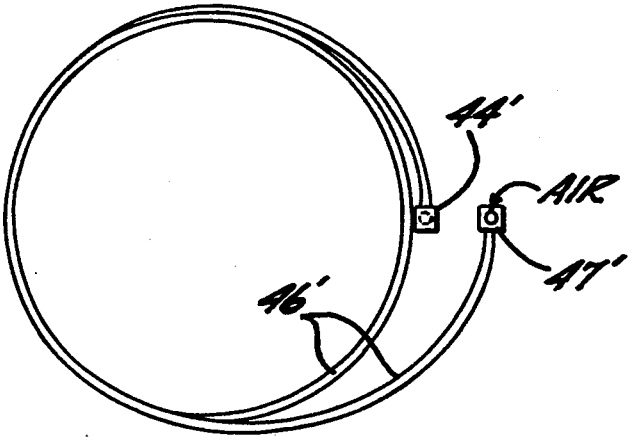
FIG. 7 is a view similar to FIG. 5 of the air supply pipe shown in FIG. 6.

Referring now to FIGS. 6 and 7, there is illustrated therein another embodiment of the fiber waste removing apparatus 20' of the present invention. Like reference characters with the prime notation added will be used to refer to like or similar parts or structure.

A carrier ring member 25' is mounted for rotation on top bed 17 by support ring 21' mounted on top bed 17 and mounting support rollers 23'. Carrier ring member 25' has a roller chain 26' mounted thereon around the periphery thereof which meshes with a drive gear or sprocket 30' mounted on the output shaft 31' of motor 32'. A reversing switch 33' is mounted on top bed 17 and is actuated by a cam 36' on carrier ring member 25'.

A housing 40' is carried by carrier ring member 25' and mounts on the bottom wall 45' thereof an air jet assembly 41'. Air jet assembly 41' includes an air jet 42' an air feed pipe 43' and a first air joint 44'. An air supply pipe 46' is connected at one end to air joint 44' and at its other end to a stationary second air joint 47'.

Air supply pipe 46' is preferably helically wound such that the coils or convolutions lie one above another in the same vertical plane rather than beside each other in the same horizontal plane, as was the case with the spiral wound pipe 46. Otherwise, the air supply pipe 46' performs in the same manner as air supply pipe 46. Similarly, the other components of apparatus 20' perform in the same manner as previously described.

Figure 8:
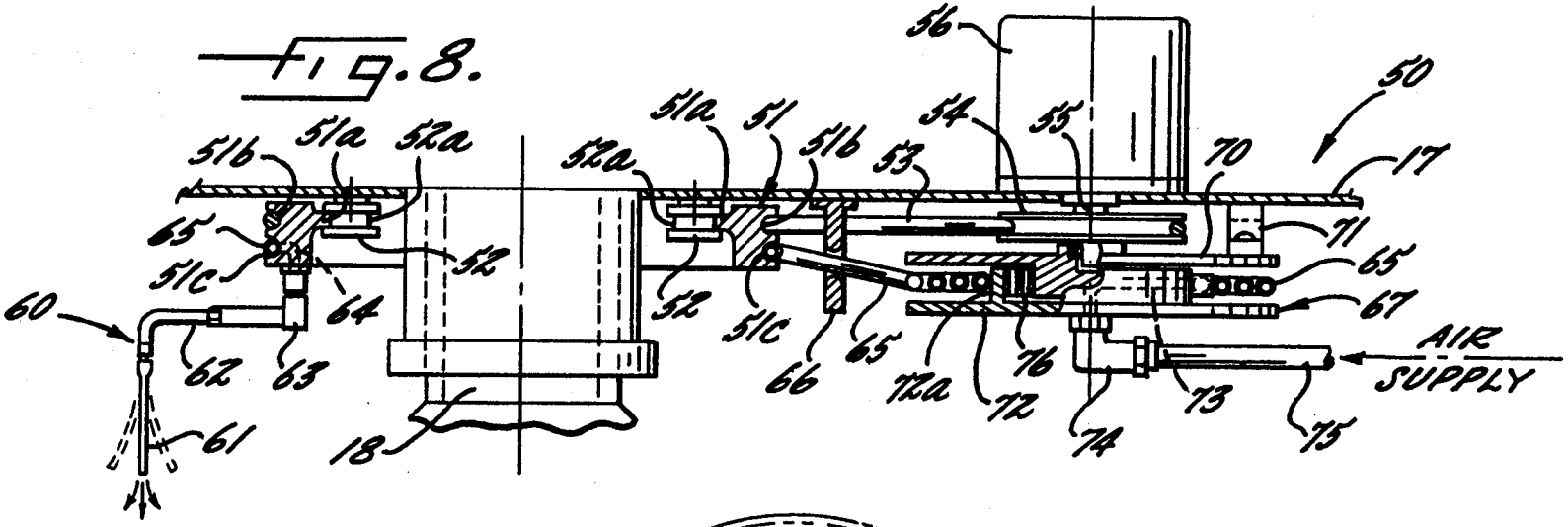
FIG. 8 is a view similar to FIGS. 2 and 6 of a further embodiment of the apparatus of the present invention.
Figure 9:
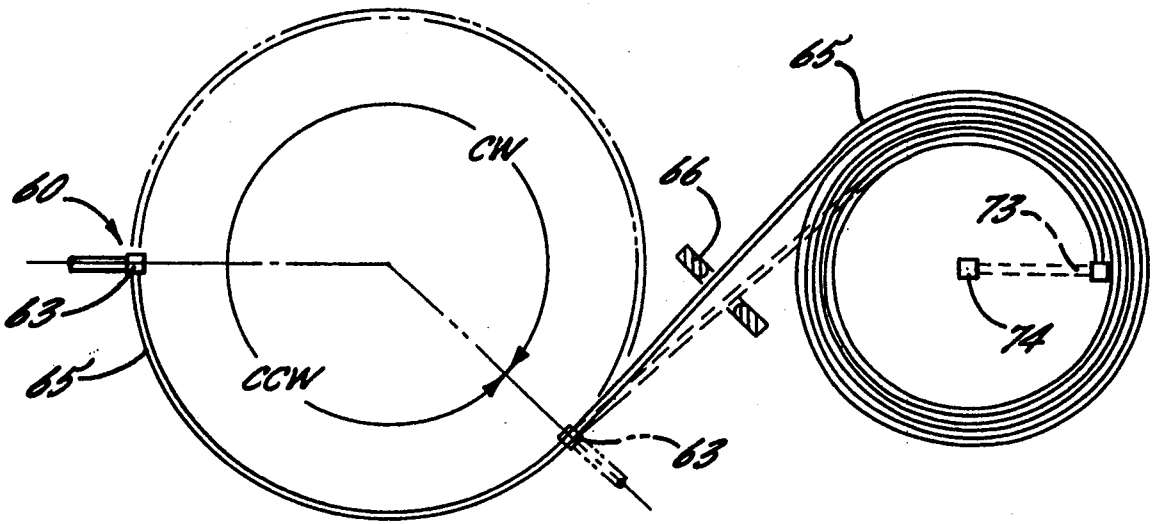
FIG. 9 is a view similar to FIGS. 5 and 7 of the air supply pipe shown in FIG. 8.

Referring now to FIGS. 8 and 9, there is illustrated a further embodiment of an apparatus for removing fiber waste from the knitting instrumentalities of a circular knitting machine which is generally indicated at 50. Apparatus 50 includes a rotatable carrier ring member 51 that is mounted for rotation coaxially of the rotary cylinder of the circular knitting machine by a plurality of rollers 52. Rollers 52 are mounted on top bed 17 and have a circumferential groove **52*a* in the outer periphery thereof. Carrier ring member 51 has an inner rib 51*a* that protrudes radially inwardly and is received in grooves 52*a* in rollers 52**.

The outer periphery of carrier ring member 51 has a first circumferential groove **51*b* in which is received a drive belt 53. The other end of drive belt 53 is entrained about a drive pulley 54 on the output shaft 55 of a drive motor 56. Drive motor 56 is a reversible electric motor which is independent of the drive system of the circular knitting machine. While not specifically illustrated, drive motor 56 will be controlled by a reversible switch (such as switch 33** in FIG. 2) or a timing switch.

An air jet or nozzle assembly 60 is carried by carrier ring member 51 and includes an air jet or nozzle 61, an air feed pipe 62 and a first air joint 63. Air joint 63 is mounted on carrier ring member 51 and communicates with one end of an air passageway 64 in carrier ring member 51. The other end of air passageway 64 communicates with a second circumferential groove **51*c* in the outer periphery of carrier ring member 51**.

An air supply tube or pipe 65 has one end thereof anchored to carrier ring member 51 in communication with air passageway 64 and lying in groove **51*c*. One end portion of air supply pipe 65 extends around carrier ring member 51 while the remainder of air supply pipe 65 extends from carrier ring member 51 through a guide 66 to a tube or pipe reel 67**, about which the other end portion thereof is wound in a plurality of convolutions.

Reel 67 includes a stationary portion 70 loosely mounted on the output shaft 55 of motor 56 and prevented from rotation by a bracket 71 mounted on top bed 17 and connected thereto. Reel 67 further includes a rotatable portion 72 loosely mounted on shaft 55 for free rotation relative thereto and relative to stationary reel portion 70. Reel portion 72 includes a hub portion 72a about which the air supply pipe 65 is wound and to which the other end of pipe 65 is anchored. Such other end of pipe 65 is in communication with an air passageway 73 which in turn communicates with an air joint 74 connected by pipe 25 to a source of compressed air (not shown).

A coil leaf spring 76 is mounted in reel 67 between stationary portion 70 and rotatable portion 72. One end of spring 76 is anchored to stationary portion 70 and the other end thereof is anchored to rotatable portion 72. Accordingly, when carrier ring member 51 is rotated by motor 56 in a clockwise direction (as shown in FIG. 9), air supply pipe 65 will be withdrawn or unwound from reel 67 while coil leaf spring 76 is wound tighter. When carrier ring member 51 is rotated counterclockwise by motor 56, air supply pipe 65 will be unwound from carrier ring member 51 and coil leaf spring 76 will rotate the rotatable reel portion 72 to rewind the air supply pipe 65 thereon.

In operation, the circular knitting machine 10 operates to knit fabric and the rotary cylinder 14 and dial 15 rotate. The motor 32 drives the carrier ring member 25 to rotate the air jet assembly 41 first in one direction for a predetermined distance, i.e. 360°, or for a predetermined time interval, and then the direction of rotation is reversed. During such rotation, a high velocity air stream is directed by nozzle 42 downwardly onto the knitting instrumentalities.

The apparatus 20 of the present invention may be used alone or in combination with other fiber waste removal and collection systems. One example of such a system is disclosed in U.S. Pat. No. 5,177,985, which is owned by the assignee of this application.

In the drawings and specifications, there has been set forth a preferred embodiment of the invention, and although specific terms are employed, they are used in a generic and descriptive sense only and not for purposes of limitation.

That which is claimed is:

1. Apparatus for removing fiber waste from knitting instrumentalities of a circular knitting machine characterized by being easily installed on new or existing circular knitting machines with only minor modification being required of the circular knitting machine, said apparatus comprising:

an air jet for blowing a high velocity stream of air onto the knitting instrumentalities of a circular knitting machine to blow fiber waste therefrom, means mounting said air jet for rotation above and relative to the knitting instrumentalities, reversible drive means independent of the circular knitting machine for rotating said air jet, reversing means mounted in the path of said air jet and connected to said reversible drive means for reversing said drive means each time said air jet reaches said reversing means, and means for connecting said air jet to a source of compressed air while accommodating rotation of said air jet relative to the knitting instrumentalities.

2. Apparatus according to claim 1 wherein said reversible drive means comprises a reversible motor connected to said air jet mounting means for rotating said air jet, said reversing means comprises a reversing switch connected to said motor for reversing said motor each time said switch is actuated, and actuating means carried by said air jet mounting means for actuating said switch upon rotation of said air jet for a predetermined distance in either direction.

3. Apparatus according to claim 1 wherein said air jet mounting means comprises a carrier ring member mounted for coaxial rotation above the rotary cylinder of the circular knitting machine and having said air jet carried thereby and depending outwardly and downwardly therefrom.

4. Apparatus according to claim 3 wherein said means for connecting said air jet to a source of compressed air comprises an air supply pipe connected at one end to and movable with said air jet and connected at the other end thereof to a compressed air source, and intermediate the ends thereof being arranged in coils or convolutions which unwind and rewind upon rotation of said air jet in opposite directions.

5. Apparatus according to claim 4 wherein said air supply pipe has the intermediate portion thereof arranged in spiral coils or convolutions.

6. Apparatus according to claim 4 wherein said air supply pipe has the intermediate portion thereof arranged in helical coils or convolutions.

7. Apparatus according to claim 3 wherein one end portion of said air supply pipe winds about the periphery of said carrier ring member upon rotation in one direction and unwinds therefrom upon rotation in the other direction, and wherein the other end portion is wound about a storage reel from which the other end portion unwinds and rewinds upon rotation of said carrier ring member.

8. Apparatus according to claim 7 wherein said storage reel includes coil spring means which is tightened by unwinding of said air supply pipe from said reel and rewinds said air supply pipe onto said reel when the direction of rotation reverses.

* * * * *

UNITED STATES PATENT AND TRADEMARK OFFICE

CERTIFICATE OF CORRECTION

PATENT NO. :5,408,851
DATED :April 25, 1995
INVENTOR(S) :Tsuchiya

It is certified that error appears in the above-indentified patent and that said Letters Patent is hereby corrected as shown below:

On the cover page, please insert under "References Cited - U. S. PATENT DOCUMENTS" the following:

| | | |
|---|---|---|
| 1,752,207 | 3/1930 | Seifert |
| 3,220,223 | 11/1965 | Schmidt |
| 3,269,151 | 08/1966 | Abrams et al. |
| 3,274,803 | 09/1966 | Schmidt |
| 3,422,640 | 01/1969 | Abrams |
| 4,505,136 | 03/1985 | Tsay |
| 4,691,536 | 09/1987 | Yorisue et al. |
| 5,000,013 | 03/1991 | Rovinsky |

On the cover page, please insert under "References Cited - FOREIGN PATENT DOCUMENTS" the following:

| | | |
|---|---|---|
| 1146414 | 03/1969 | United Kingdom |
| 1326674 | 07/1987 | Russia |
| 1585163 | 03/1972 | Germany |
| 2708436 | 07/1978 | Germany |
| 1061943 | 07/1959 | Germany |
| 7638042 | 05/1978 | Germany |

Signed and Sealed this

Twelfth Day of September, 1995

Bruce Lehman

*Attest:*

BRUCE LEHMAN

*Attesting Officer*

*Commissioner of Patents and Trademarks*